US006571576B1

(12) United States Patent
Lifson et al.

(10) Patent No.: US 6,571,576 B1
(45) Date of Patent: Jun. 3, 2003

(54) INJECTION OF LIQUID AND VAPOR REFRIGERANT THROUGH ECONOMIZER PORTS

(75) Inventors: Alexander Lifson, Manlius, NY (US); James W. Bush, Skaneateles, NY (US); Michael F. Taras, Fayettevile, NY (US); Howard H. Fraser, Jr., New Woodstock, NY (US); Russell G. Lewis, Manlius, NY (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 10/115,622

(22) Filed: Apr. 4, 2002

(51) Int. Cl.[7] ..... F25B 41/00; F25B 1/00
(52) U.S. Cl. ..... 62/513; 62/196.1; 62/228.5
(58) Field of Search ..... 62/513, 498, 196.1, 62/228.1, 228.5, 197, 505, 510

(56) References Cited

U.S. PATENT DOCUMENTS 5,996,364 A 12/1999 Lifson et al.
6,318,100 B1 * 11/2001 Brendel et al. ..... 62/217
6,385,981 B1 * 5/2002 Vaisman ..... 62/513

* cited by examiner

*Primary Examiner*—Chen Wen Jiang
(74) *Attorney, Agent, or Firm*—Carlson, Gaskey & Olds

(57) ABSTRACT

An improved apparatus and method for injecting a liquid/vapor into compression chambers at an intermediate pressure utilizes the economizer injection ports already found in the compressor. By selectively communicating a liquid to be injected into the compression chambers to the economizer return line, the economizer return line and its ports are utilized for this liquid/vapor injection. In this way, no additional flow connections at the compressor are necessary. Moreover, by injecting the liquid at an intermediate pressure point, the other benefits are provided. In general, the liquid is injected to reduce the discharge temperature of the refrigerant under certain operational conditions.

8 Claims, 2 Drawing Sheets

INJECTION OF LIQUID AND VAPOR REFRIGERANT THROUGH ECONOMIZER PORTS

BACKGROUND OF THE INVENTION

This application relates to a refrigerant compressor wherein a vapor/liquid mixture is injected into intermediate pressure chambers through the economizer ports, thus removing any necessity for providing separate ports for vapor injection and for liquid injection.

Compressors are utilized to compress refrigerant for refrigerant compression applications such as air conditioning, refrigeration, etc. There are many challenges to the provision of the most efficient control of refrigerant circuits. In particular, under certain operational conditions, it would be desirable to achieve increased capacity or increased efficiency operation for the refrigerant circuit. One way of achieving increased capacity or increased efficiency is the inclusion of an economizer circuit into the refrigerant circuit. An economizer circuit essentially provides heat transfer between a main refrigerant flow downstream of a condenser and a second refrigerant flow which is tapped downstream of the condenser and passed through an expansion valve. The main flow is cooled in a heat exchanger by the second flow.

In this way, the main flow from the condenser is cooled before passing through its own expansion valve and entering the evaporator. Since the main flow enters the expansion valve at a cooler temperature, it has greater capacity to absorb heat in the evaporator which results in increased system cooling capacity. The refrigerant in the second flow enters the compression chamber in the compressor at a point downstream of suction and upstream of discharge. That is, the refrigerant from the second flow line is injected into economizer ports at an intermediate compression point. Because the injector vapor is at an intermediate pressure, it requires less energy to compress it to the discharge or condenser pressure than if it has been injected at the suction or evaporator pressure. This results in a reduction of specific work in the compressor which in turn results in improved system efficiency.

One type of compressor which utilizes an economizer is a scroll compressor. Typically, a pair of spaced economizer injection ports inject the fluid into the intermediate pressure chambers.

Recently, a system has been developed by the assignee of this application wherein an unloader valve function also operates through the economizer ports. A valve is selectively opened to control the unloader function, and allow fluid to flow from the economizer ports through the unloader valve and back to a suction supply line.

Further, it is sometimes desirable to provide a liquid/vapor refrigerant mixture into the compression chambers to reduce the discharge temperature of the refrigerant. At certain operational conditions, lowering the discharge temperature has significant benefits. In particular, at high saturated condensing temperature, high pressure ratio, or high superheat conditions, it is desirable to lower the discharge temperature. Injecting a vapor/liquid mixture into the compression chambers has the effect of lowering the discharge temperature. However, in general separate injection ports have been utilized. It is also common for a single set of ports to be provided for either economized operation or for liquid injection, but not for both.

SUMMARY OF THE INVENTION

In the disclosed embodiment of this invention, an economizer return line selectively communicates with a liquid tap tapping liquid refrigerant downstream of the condenser. A valve on this liquid tap line selectively communicates the liquid to the economizer return line, and eventually through the economizer ports into the compression chambers. This valve can be open when it is desired to lower the discharge temperature of the refrigerant. The valve can be opened in combination with the economizer valve being open, or could be used when the economizer valve is closed. Further, the valve may be utilized to supply the liquid during unloaded operation.

By injecting the liquid through the economizer ports, the provision of separate economizer and liquid injection ports is made unnecessary. Further, the injection of the liquid refrigerant into the intermediate location, rather than the prior art injection at suction does not dilute the compressor sump.

These and other features of the present invention can be best understood from the following specification and drawings, the following of which is a brief description.

DETAILED DESCRIPTION OF A PREFERRED EMBODIMENT

Figure 1:
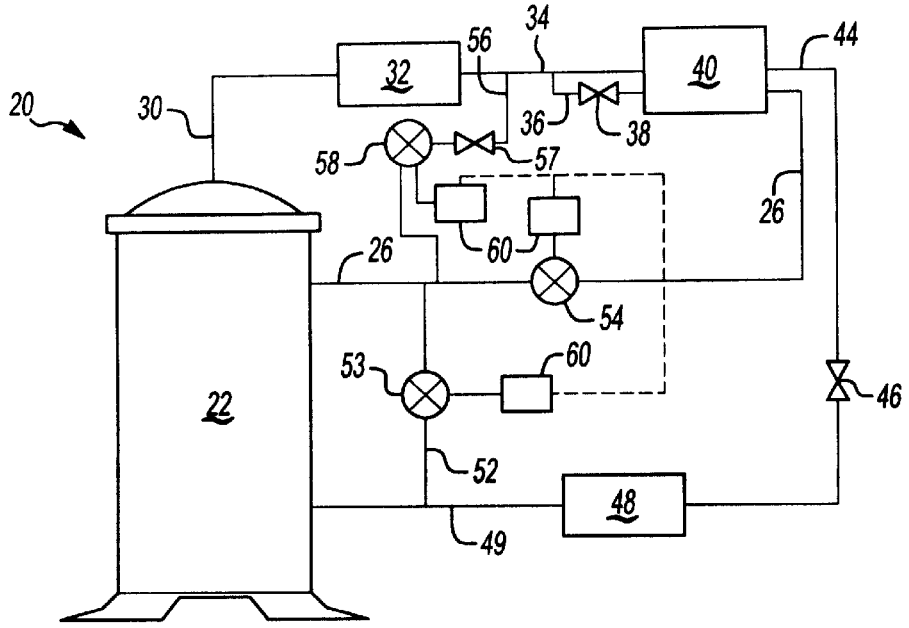
FIG. 1 is a schematic view of a refrigerant system incorporating the instant invention.
Figure 1A:
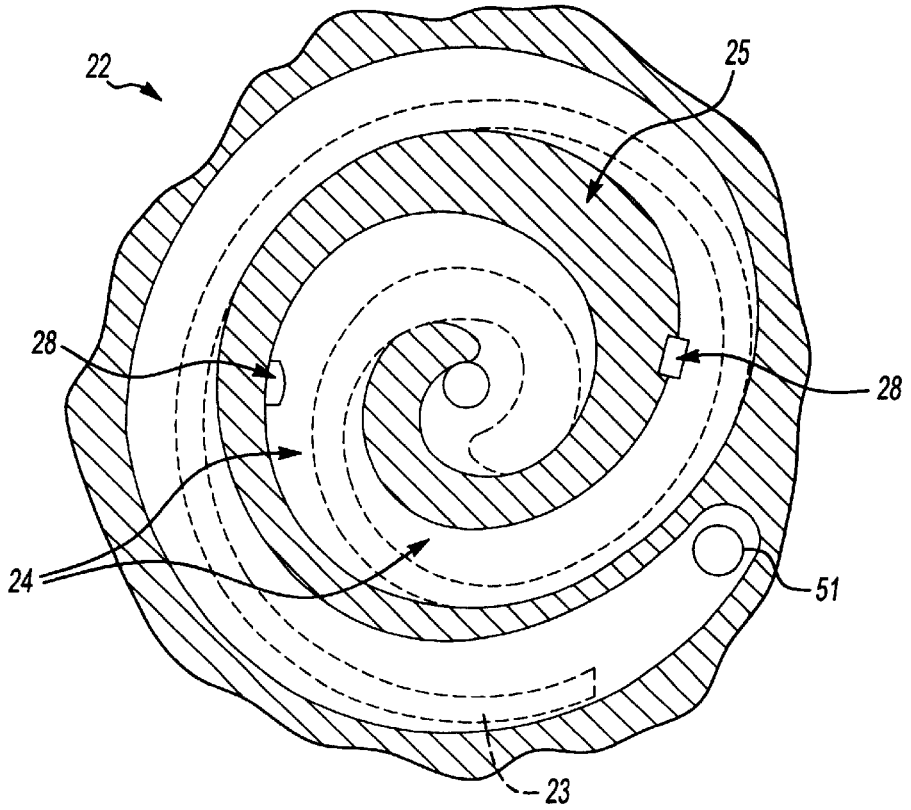
FIG. 1A is a cross-sectional view of a scroll compressor.

FIG. 1 shows a refrigerant circuit 20 incorporating scroll compressor 22. As shown in FIG. 1A, the compressor 22 includes an orbiting scroll 23 and a non-orbiting scroll 25. As is known, the two scroll members define compression chambers 24. An economizer injection line 26 communicates with two injection ports 28 for injecting an economized fluid back into the compression chambers 24 at a point intermediate the suction and discharge pressure. While the present invention is specifically disclosed in a scroll compressor, the invention is also applicable to other types of compressors. In particular, screw compressors will also benefit from this invention.

As is known, a discharge line 30 from the compressor leads to a condenser 32. A condenser outlet 34 leads to an economizer heat exchanger 40. A tap line 36 taps off a portion of the outlet line 34 and passes through an expansion valve 38. When the two fluid flows in the line 34 and 36 pass through the heat exchanger 40, heat is taken away from the fluid in the line 34 by the fluid in the line 36. The main flow line 34 continues to the outlet 44 of the economizer heat exchanger 40, and eventually to a main expansion valve 46. From the expansion valve 46, the refrigerant passes through the evaporator 48. From evaporator 48, refrigerant returns through a line 49 to a suction port 51 in the compressor 22. The tap line 36 continues to a second outlet 26 of the economizer heat exchanger 40 and eventually to compressor 22 where the refrigerant enters into compression chamber 24 through injection ports 28.

As is disclosed in U.S. Pat. No. 5,996,364, optional line 52 includes a selectively opened valve 53 to connect the suction line 49 to the economizer line 26. When the valve 53 is opened, an economizer valve 54 is typically closed. When the valve 53 is opened, refrigerant moves through the ports 28, into the line 52, and back to the suction 49. This control is affected by a control 60 when a reduced capacity is desired. Again, control 60 will open the valve 54 and close the valve 53 when economized operation is desired. Although the valve 54 is illustrated as being located on line 26, it is to be understood that the valve 54 can also be located on line 36 instead.

The circuit as disclosed to this point is generally as known. The present invention is directed to the inclusion of a tap 56 to tap liquid from the condenser 32. A valve 58 and expansion valve 57 is mounted on line 56 and controls the flow of the liquid to the economizer line 26. By including liquid into the line 26, liquid is injected into the compression chambers 24 at an intermediate pressure position. Since the economizer ports 28 are used to inject the liquid, in addition to economizer vapor, no additional flow structure is necessary at the compressor. The present invention thus achieves the injection of liquid into the intermediate compression chambers, and the resulting reduction in discharge temperature without the necessity of providing additional flow connections, etc., at the compressor.

The valve 58 is controlled by control 60 and may be opened such that it injects liquid in conjunction with the economizer valve 54 being open, or in conjunction with the unloader valve 53 being open. Further, the valve 58 can also be opened when both valves 53 and 54 are closed.

Generally, the control 60 will be programmed to determine which types of operational states would make the injection of liquid beneficial into the compression chambers 24.

Although it is disclosed and illustrated that the valves 57 and 58 are separate components, it is to be understood that the valves 57 and 58 can be combined into a single component. Valves 36 and 54 can also be combined into a single component. Additionally, the expansion valves 36 and 57 could also be a capillary tube or a fixed orifice.

Figure 2:
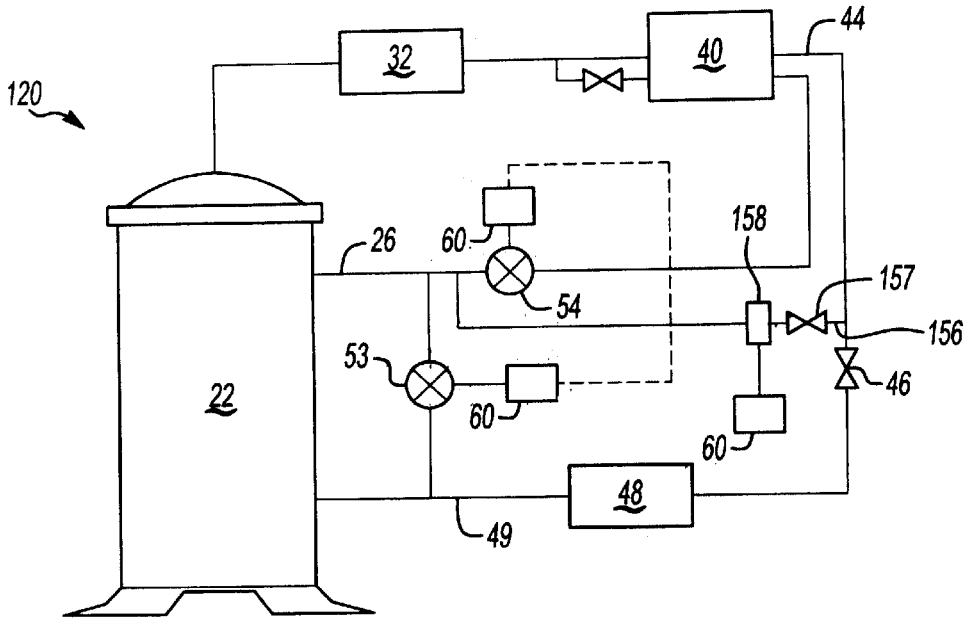
FIG. 2 shows a second embodiment.

As shown in FIG. 2, second embodiment 120 is similar to the FIG. 1 embodiment except the tap 156 is intermediate the outlet 44 of the economizer heat exchanger and the main expansion valve 46. Again, the tap 156 taps liquid that passes through an expansion device 157 and to the shut-off valve 158. The valve 158 is again opened to inject liquid into the line 26, and eventually into the economizer injection ports 28. The operation and control of this embodiment is similar to the FIG. 1 embodiment.

Figure 3:
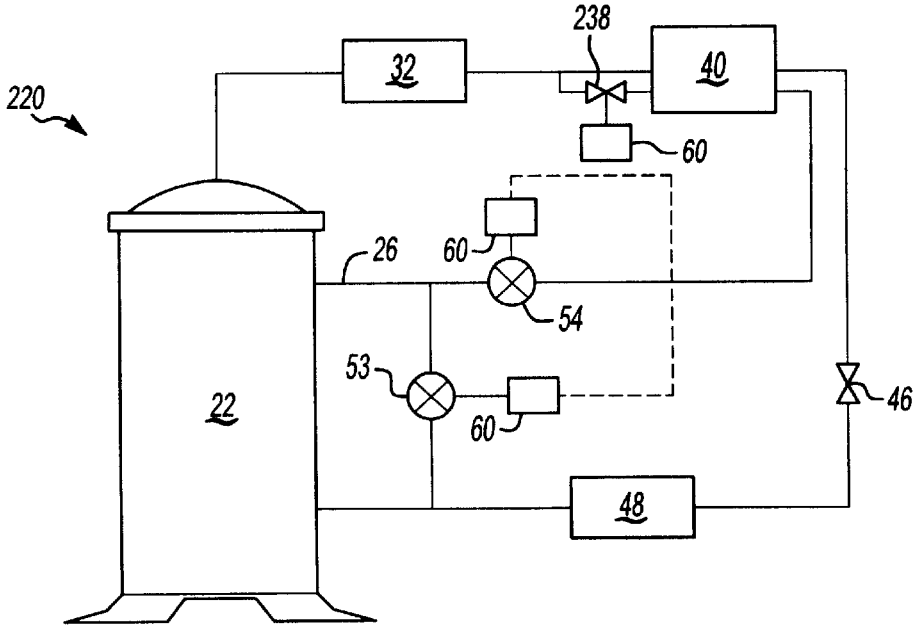
FIG. 3 shows yet another embodiment.

FIG. 3 shows yet another embodiment 220 wherein the economizer expansion valve 238 is an electronic expansion valve. Such a valve can be controlled by the control 60 to over flood the economizer circuit so that a controlled amount of liquid refrigerant is returned through the economizer return line 26 whenever economized operation is occurring. This eliminates the need for any separate liquid injection line.

The tapping of the liquid refrigerant is within the level of ordinary skill in the art. Further, while separate "controls" are illustrated in the drawings, it should be understood that a single computer control may also control all of the elements as set forth in the schematic figures.

The present invention thus achieves the injection of a liquid refrigerant into the compression chambers at an intermediate pressure in an economized system, and without additional flow connections to the compressor 22.

While a preferred embodiment has been disclosed, a worker of ordinary skill in this art would recognize that certain modifications would come within the scope of this invention. For that reason the following claims should be studied to determine the true scope and content of this invention.

What is claimed is:

1. A refrigerant cycle comprising:

a compressor having a suction line, a discharge line, and intermediate pressure compression chambers at a pressure intermediate suction and discharge;

a condenser communicating with said discharge line of said compressor;

an economizer heat exchanger and an economizer tap tapping economizer fluid from an outlet line of said condenser, said tap passing through an economizer expansion valve upstream of said economizer heat exchanger such that heat is exchanged between a main outlet line of said condenser and said economizer tap in said economizer heat exchanger;

said main flow line passing through a main expansion device, and then to an evaporator;

said economizer fluid passing through an economizer valve, into an economizer return line and to injection ports for communicating said economizer fluid back to said intermediate pressure compression chambers; and a liquid tap line for tapping liquid refrigerant and injecting it into said compression chambers through said economizer ports.

2. A refrigerant cycle as recited in claim 1, wherein said compressor is a scroll compressor, and there are a pair of spaced economizer injection ports for communicating with said intermediate pressure compression chambers.

3. A refrigerant cycle as recited in claim 1, wherein there is an unloader valve mounted on a line connecting said economizer return line and said suction line, with a control selectively opening said unloader valve.

4. A refrigerant cycle as recited in claim 1, wherein a separate liquid injection valve is included on a line connecting said tap line to said economizer return line, said liquid injection valve being controlled such that it may be opened when said unloader valve is also opened.

5. A refrigerant cycle as recited in claim 4, wherein said economizer valve and said liquid injection valve may both be opened at the same time.

6. A refrigerant cycle as recited in claim 1, wherein said liquid tap line is tapped from a location intermediate said economizer tap and said condenser discharge line.

7. A refrigerant cycle as recited in claim 1, wherein said liquid tap being on said main outlet line, and intermediate said economizer heat exchanger and said main expansion device.

8. A refrigerant cycle as recited in claim 1, wherein said liquid tap line is provided by said economizer tap, and by controlling said economizer expansion valve to inject additional liquid into said economizer return line.

* * * * *

UNITED STATES PATENT AND TRADEMARK OFFICE

CERTIFICATE OF CORRECTION

PATENT NO. : 6,571,576 B1
DATED : June 3, 2003
INVENTOR(S) : Lifson et al.

It is certified that error appears in the above-identified patent and that said Letters Patent is hereby corrected as shown below:

Title page,
Item [75], Inventor Taras' city should read as follows:
-- Michael F. Taras, Fayetteville, NY --

Signed and Sealed this

Twenty-third Day of September, 2003

JAMES E. ROGAN
*Director of the United States Patent and Trademark Office*